US010815781B2

(12) United States Patent
Galler et al.

(10) Patent No.: US 10,815,781 B2
(45) Date of Patent: Oct. 27, 2020

(54) ACTIVE TEMPORARY ROOF SUPPORT APPARATUS

(71) Applicant: SANDVIK INTELLECTUAL PROPERTY AB, Sandviken (SE)

(72) Inventors: Thomas Galler, Mur (AT); Bruno Reumuller, Knittelfeld (AT)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 16/307,550

(22) PCT Filed: Jun. 10, 2016

(86) PCT No.: PCT/EP2016/063327
§ 371 (c)(1),
(2) Date: Dec. 6, 2018

(87) PCT Pub. No.: WO2017/211429
PCT Pub. Date: Dec. 14, 2017

(65) Prior Publication Data

US 2019/0153863 A1 May 23, 2019

(51) Int. Cl.

| | |
|---|---|
| ***E21D 23/00*** | (2006.01) |
| ***E21C 27/24*** | (2006.01) |
| ***E21D 19/04*** | (2006.01) |
| ***E21D 20/00*** | (2006.01) |
| ***E21D 11/40*** | (2006.01) |

(52) U.S. Cl.
CPC ..... *E21D 23/0095* (2013.01); *E21C 27/24* (2013.01); *E21D 11/40* (2013.01); *E21D 19/04* (2013.01); *E21D 20/003* (2013.01)

(58) Field of Classification Search
CPC combination set(s) only.
See application file for complete search history.

(56) References Cited

U.S. PATENT DOCUMENTS 3,837,170 A * 9/1974 Martinko ..... E21D 23/0039 405/295
4,010,618 A * 3/1977 Walker ..... E21D 23/0017 405/290

FOREIGN PATENT DOCUMENTS

| | | | |
|---|---|---|---|
| CN | 2188654 | Y | 2/1995 |
| CN | 200982201 | Y | 11/2007 |
| CN | 201225163 | Y | 4/2009 |
| CN | 101493014 | A | 7/2009 |
| CN | 201318185 | Y | 9/2009 |
| CN | 202012364 | U | 10/2011 |
| CN | 202611695 | U | 12/2012 |

(Continued)

OTHER PUBLICATIONS

CN 204716236 machine translation (Year: 2015).*

*Primary Examiner* — Kyle Armstrong
(74) *Attorney, Agent, or Firm* — Corinne R. Goski

(57) ABSTRACT

An active temporary roof support apparatus for attachment to a mining machine includes at least one set of support members, each set including at least a first support member and a second support member for supporting the roof of an underground tunnel. A drive assembly is arranged to drive the set of support members, such that the first and second support members are sequentially moved for engaging the roof so that the roof is supported by at least one support member during an excavation operation of the mining machine. A mining machine and a corresponding method is also provided.

17 Claims, 8 Drawing Sheets

(56) References Cited

FOREIGN PATENT DOCUMENTS

| | | | | | |
|---|---|---|---|---|---|
| CN | 103195457 | A | | 7/2013 | |
| CN | 103470292 | A | | 12/2013 | |
| CN | 103485812 | A | | 1/2014 | |
| CN | 103670425 | A | | 3/2014 | |
| CN | 104500086 | A | | 4/2015 | |
| CN | 104533489 | A | | 4/2015 | |
| CN | 204716236 | U | | 10/2015 | |
| CN | 105178992 | A | | 12/2015 | |
| DE | 3827403 | C1 | | 12/1989 | |
| GB | 2050482 | A | * | 1/1981 | ..... E21D 23/0039 |
| SU | 163568 | A1 | | 7/1964 | |
| SU | 877036 | A1 | | 10/1981 | |

* cited by examiner

ACTIVE TEMPORARY ROOF SUPPORT APPARATUS

RELATED APPLICATION DATA

This application is a § 371 National Stage Application of PCT International Application No. PCT/EP2016/063327 filed Jun. 10, 2016.

FIELD OF INVENTION

The present invention relates to an active temporary roof support apparatus for a mining machine comprising at least one set of support members, each set comprising at least a first support member and a second support member for supporting the roof of an underground tunnel. The invention also relates to a mining machine, in particular a continuous miner, comprising a main frame, a cutting unit, and an active temporary roof support apparatus of the aforementioned type. Moreover, the invention relates to a method for temporarily supporting a roof of an underground tunnel during cutting the tunnel.

BACKGROUND ART

A variety of different types of excavation machines have been developed for cutting drifts, tunnels, subterranean roadways and the like in which a cutting unit is mounted on a main frame so as to create a desired tunnel cross-sectional profile. During the cutting operation, the mining machine advances forward through the rock. In general, such mining machines comprise a unit for installing a permanent roof support. Such a unit may comprise a bolter and a mesh handler. A mesh is bolted against the ceiling of the underground tunnel for preventing rocks or brittles to fall from the ceiling.

However, for placing and fixing such a mesh, a specific length of free ceiling between the cutting head and the bolting unit is needed. Thus, there is an area of unsupported tunnel ceiling between the cutting head and the permanently supported portion of the ceiling. It is known to secure these portions by means of a temporary roof support. Such a device for example is disclosed in DE 3827403 C1. The disclosed device positions and holds temporary beams against a roof portion of an underground tunnel. These beams afterwards are fixed permanently.

A similar device is disclosed in CN 103470292. This system comprises two independent first and second hydraulic lifting supporting frames. One of the frames is provided with a mesh handler for positioning a mesh. The frames are constructed to be arranged over a mining machine, such that the mining machine can move under the supporting system.

Further similar devices are disclosed in CN 105178992, CN 103195457, CN 201318185, CN 200982201 and CN 2188654.

A problem associated with all these devices is that on the one hand they are formed as separate units from the mining machine and thus need to be positioned and moved separately from the mining machine. In practice the known stand-alone devices of the prior art need to be retracted while the mining machine is in operation, leading to periods of time when the roof is not supported. This causes unsafe conditions and may lead to damages. Moreover such replacement is time consuming.

A further drawback is, that the known devices require a free space on side portions of the mining machine for providing the supporting force. The devices comprise foot plates supporting posts which bear against the roof for supporting the roof. Thus, there are cases where the tunnel needs to be broader in width for accommodating such known devices. Thus, there is less space for the mining machine or service persons.

Moreover, it has been shown that these devices are difficult to use in bad conditions, i.e. conditions in which the roof of the underground tunnel is very brittle and has the tendency to rockfalls.

SUMMARY OF THE INVENTION

It is an objective of the invention to provide an active temporary roof support apparatus for a mining machine attachable to a mining machine, a mining machine, and a corresponding method allowing a continuous roof support also in bad mining conditions.

This objective is solved according to a first aspect of the invention by an active temporary roof support apparatus of the type specified in the introductory portion, which comprises a drive assembly for driving the set of support members such that the first and second support members are sequentially moved for engaging the roof such that the roof is supported by at least one support member during an excavation operation of the mining machine. Due to the sequential movement of the first and second support members, at least one of them, or a support member of an additional set of support members, is in contact with the roof, such that the roof is continuously supported by the roof support apparatus. The apparatus acts in the manner of a self-adjusting support or walking support. The first and second members of the at least one set of support members "walk" along the roof, such that always at least one of the support members is in contact with the roof. The drive assembly drives the set of support members such that the support member, which is not in contact with the roof, is preferably advanced simultaneously with the associated mining machine or excavation apparatus, such that continuous support during excavation is provided. In other words, the first and second support members are provided for mutual and/or alternating engagement of the roof. At all points of time during the supporting action the first, the second or both support members of the set of support are in contact with the roof such that a continuous support is provided. In an exemplary movement, the first support member is placed and engaged with the roof. While the first support member stays in contact with the roof, the second support member can be moved and advanced forward and subsequently placed and engaged adjacent or distal from the first support member. When the second support member engages the roof, the first support member may be repositioned. Thus, the roof is always supported by at least one of the support members of the set of support members and therefore safety is greatly increased.

The support by the active temporary roof support apparatus preferably is at least provided until the permanent roof support is installed. Preferably, the support members are plate-shaped, shaped according to an inverted conic or have a grid form. It should be understood that any other geometry is possible and preferred, dependent on the associates mining machine, mining conditions and/or a number of support members. Preferably, the active temporary roof support apparatus is mounted on a mining machine and in particular supported by a frame of the mining machine. This helps that the roof support apparatus can move together with the mining machine and there is no necessity to separately move and position the roof support apparatus.

It should be understood that the drive assembly for driving the set of support members such that the first and second support members are sequentially moved, may comprise separate and independent drives for each support member of each set of support members as specified in more detail below. Thus, the drive assembly is preferably adapted to separately drive the first support member and the second support member.

According to a first preferred embodiment the active temporary roof support apparatus further comprises a second set of support members, wherein the sets of support members are arranged adjacent to each other facing the advanced direction of the machine. The advanced direction of the machine is also referred to as the machine direction, namely the direction in which the machine advances on an excavation operation. It should be understood that also third, fourth, fifth and so forth sets of support members may be provided for one active temporary roof support apparatus for one mining machine. The number of sets of support members depends on the type of mining machine, mining operation, and the roof of the tunnel. When the apparatus according to this invention is used with the mining machine, the sets of support members are preferably arranged on a horizontal line perpendicular to the machine direction. The first and second support members of the sets of support members advance in sequence simultaneously with the excavation operation for supporting the roof substantially over the whole width. This helps that the roof support apparatus provides a high level of safety even in bad mining conditions.

In a further preferred development of the invention, the drive assembly is adapted to move the first and second support members of the first set of support members oppositely relative to the first and second support members of the second set of support members. Thus, the outer support members move forward, while the inner support members rest supporting the roof, and vice versa. This leads to a stable support of the roof portion and to a symmetrical arrangement of the support members and thus to an increased safety level. When the active temporary roof support apparatus comprises two sets of support members, it is preferred that in use always two support members, i.e. one support member of each set of support members, is in contact with the roof of the tunnel for supporting the roof.

Preferably, the first and second support members are connected to each other. Preferably, the first and second support members are directly connected to each other. Due to such an arrangement, the first and second support members of each set of support members form a unit, which allows a simple placement of the support members against the roof of the underground tunnel and ultimately an improved support of the roof. Additionally, it may be provided that also the first, second, third and so forth sets of support members are connected to each other.

Moreover, it is preferred that the first and second support members are in sliding engagement with each other. When advancing one of the support members, this support member slides with respect to the other support member and the support members stay connected to each other.

In a preferred embodiment, the first support member comprises a first engaging portion and the second support member comprises a second engaging portion corresponding to and engaging the first engaging portion. Preferably, these engaging portions are formed according to a dove tale connection on a longitudinal side of the support members. Preferably, the first and second engaging portions allow movement of the first and second support members relative to each other and substantially in the machine direction. As described above, it is essential that always one of the support members supports the roof, while the other support member is free to follow the mining machine on an excavation operation, such that the respective support member can be replaced. This allows the walking action of the support members of each set of support members for supporting the roof continuously. Thus, it is preferred that the support members can move relative to each other, even when they are engaged with each other. The support members stay engaged during reposition of either the first or second support member. This also means that the advance of the set is shorter than the double length of each support member. This restricts the increment or step width when advancing the active temporary roof support apparatus in use.

Moreover it is preferred that the first and second engaging portions allow pivoting the first and second support members to each other in a predetermined angular range. The angular range preferably is small, e.g. in a range from 10° to 45°, in particular 10° to 30°. When repositioning one of the first and second support members, this support member needs to be disengaged from the roof portion to allow movement. In this operation, it is preferred that the support member, which is to be repositioned, is slightly pivoted with respect to the other support member which stays in contact with the roof, such that the repositioning of the other support member is simplified. When the engaging portions are formed according to a dove tail connection, this dove tail connection may be provided with predetermined tolerances, such that a pivot movement of the first and the second support member to each other is allowed.

According to a further preferred embodiment, the drive assembly comprises first and second upright drives for moving the first and second support members respectively to the roof. Thus, according to this embodiment, each support member is provided with a respective upright drive. When e.g. two sets of support members are provided for the active temporary roof support apparatus and each set comprises two support members, i.e. first and second support members, in total the active temporary roof support apparatus comprises four upright drives. Thus, it is allowed, to engage each support member with a respective engaging forth to the roof portion of the underground tunnel for supporting the roof. This increases safety of the apparatus.

Preferably, the drive assembly moreover comprises first and second forward drives for moving the first and second support members respectively in the machine direction. Again, it is preferred that each support member comprises its own and separate forward drive, such that each support member is separately and independently from each other positionable in the machine direction. Such forward drives may be supported by a machine frame of a respective mining machine, or may be supported against the upright drives. In such an arrangement the walking action of the support members as described above is simplified.

The invention solves the above-mentioned problem in a second aspect by a mining machine, in particular continuous miner, comprising a main frame, a cutting unit, and an active temporary roof support apparatus attached to the main frame and arranged in machine direction immediately behind the cutting unit. The cutting unit normally is movable with respect to the main frame for carrying out an excavation operation. The main frame provides support for the cutting forces and during the cutting operation the main frame is braced against the tunnel walls, in particular against the floor and the roof of the underground tunnel. Immediately behind the cutting unit in this instance means that the active temporary roof support apparatus is attached to the main frame such that front edges of the respective support members are in a range from 500 mm to 2.000 mm from the cutting unit, measured from a cutting point of the cutting unit in the machine direction. This is an exemplified range. For smaller or larger mining machines comprising a differently sized cutting unit the applicable range will be another range.

It shall be understood that the active temporary roof support apparatus according to the first aspect of the invention and the mining machine according to the second aspect of the invention comprise identical and similar aspects, as in particular defined in the dependent claims. Insofar reference is made to the above description of the active temporary roof support apparatus according to the first aspect of the invention, in particular with respect to the preferred embodiments and technical effects of the features.

According to a first preferred embodiment of the mining machine, the mining machine comprises a machine stabilization having a support member arranged behind the active temporary roof support apparatus for stabilizing the mining machine during an excavation operation. This machine stabilization is used to brace the mining machine against the roof of the tunnel. Also this support member of the machine stabilization provides roof support and prohibits rocks and brittles from falling from the roof.

The above-mentioned problem is moreover solved in a third aspect of the invention by a method for temporary supporting a roof of an underground tunnel during cutting the tunnel, comprising the steps in the following order: engaging a first area of the roof with a first support member; engaging a second area of the roof with a second support member; disengaging the first support member from the first area; engaging a third area of the roof with said first support member; and disengaging the second support member from the second area. Preferably, the method further comprises similar further steps which may continue with: engaging a fourth area of the roof with said second support member, disengaging the first support member from the third area, engaging a fifth area with said first support member, and so forth. This method thus provides a walking action of the first and second support members on the roof of the underground tunnel, for supporting the roof of the underground tunnel during cutting the tunnel. At least one of the support members is in contact with the roof of the underground tunnel at all times, so that a continuous support of the roof is achieved. It shall be understood, that when more than two support members are provided, e.g. when using an active temporary roof support apparatus having two or more sets of support members, as described above with respect to the first aspect of the invention, it is sufficient when one of the support members engages the roof. It is the idea of the invention, that at least one of the support members engages the roof of the underground tunnel at all stages of the cutting process, so that the roof is continuously supported.

It shall be understood, that the active temporary roof support apparatus according to the first aspect of the invention, the mining machine according to the second aspect of the invention and the method for temporary supporting a roof of an underground tunnel during cutting the tunnel according to the third aspect of the invention comprise identical and similar aspects, as in particular defined in the dependent claims. Insofar, reference is made to the above description of the active temporary roof support apparatus according to the first aspect of the invention and the mining machine of the second aspect of the invention, in particular with regard to the preferred embodiments and the technical effects of features.

According to the first preferred embodiment of the method, the first, second, and third areas are arranged adjacent to each other and offset in the machine direction.

Preferably, the first, second, and third areas are arranged immediately behind a cutting unit of a corresponding mining machine, preferably in a range from 500 mm to 2.000 mm from the cutting unit. This range is measured from a front edge of the first, second and third areas and a point of cutting of the cutting unit. This is one possible range, which e.g. for a larger mining machine can be chosen to be larger.

Preferably, the method furthermore comprises after disengaging the first support member the steps: pushing the first support member forward in machine direction by a first range which is less than a distance twice as long as the length of the second support member seen in the machine direction. Preferably the first support member is only pushed forward by a range that is less than the length of the second support member seen in the machine direction. Thus, the support members are pushed forward in an "overlapping" manner, so that the roof is continuously supported. It shall be noted that it is not essential whether the first or second support member is moved first. When supporting a roof it may also be preferred to first position the second support member.

According to a further preferred embodiment of the method, at least one support member is controlled to advance substantially simultaneously with the cutting unit. During an excavation operation, the cutting unit advances into the rock and preferably at least one of the support members, in particular the support member which is not engaged with the roof, is simultaneously advanced with the cutting unit. Preferably, the support member is engaged with the roof, when the cutting unit stops cutting. This again increases the safety and prevents rocks and brittles from falling down.

Preferably, the steps of the method according to the third aspect of the invention are carried out simultaneously as cutting the tunnel. Preferably, this method of the third aspect is carried out using an active temporary roof support apparatus according to the first aspect of the invention.

Preferably, at least one of the support members is adapted to provide an active support force to the roof in substantially vertical direction. Such a support force may be provided by a drive unit, in particular an upright drive, which presses the support member against the roof. Preferably, such a step is carried out during engaging of the first or second support member with one of the areas. This helps to stabilize the roof portion and to prevent brittles or rocks from falling down.

The detailed description will illustrate and describe what is considered as a preferred embodiment of the invention. It should of course be understood that various modifications and changes in form or detail could readily be made without departing from the spirit of the invention. It is therefore intended that the invention may neither be limited to the exact form and detail shown and described herein, nor to anything less than the whole of the invention disclosed herein and as claimed hereinafter. Further, the features described in the description, the drawings and the claims disclosing the invention may be essential for the invention considered alone or in combination. In particular, any reference signs in the claims shall not be construed as limiting the scope of the invention. The wording "comprising" does not exclude other elements or steps. The wording "a" or "an" do not exclude the plural. The wording "a number of" items, comprises also the number 1, i.e. a single item, and further numbers like 2, 3, 4, and so forth.

In the following the invention will be described in more detail with respect to the accompanying drawings, in which:

DETAILED DESCRIPTION

Figure 1:
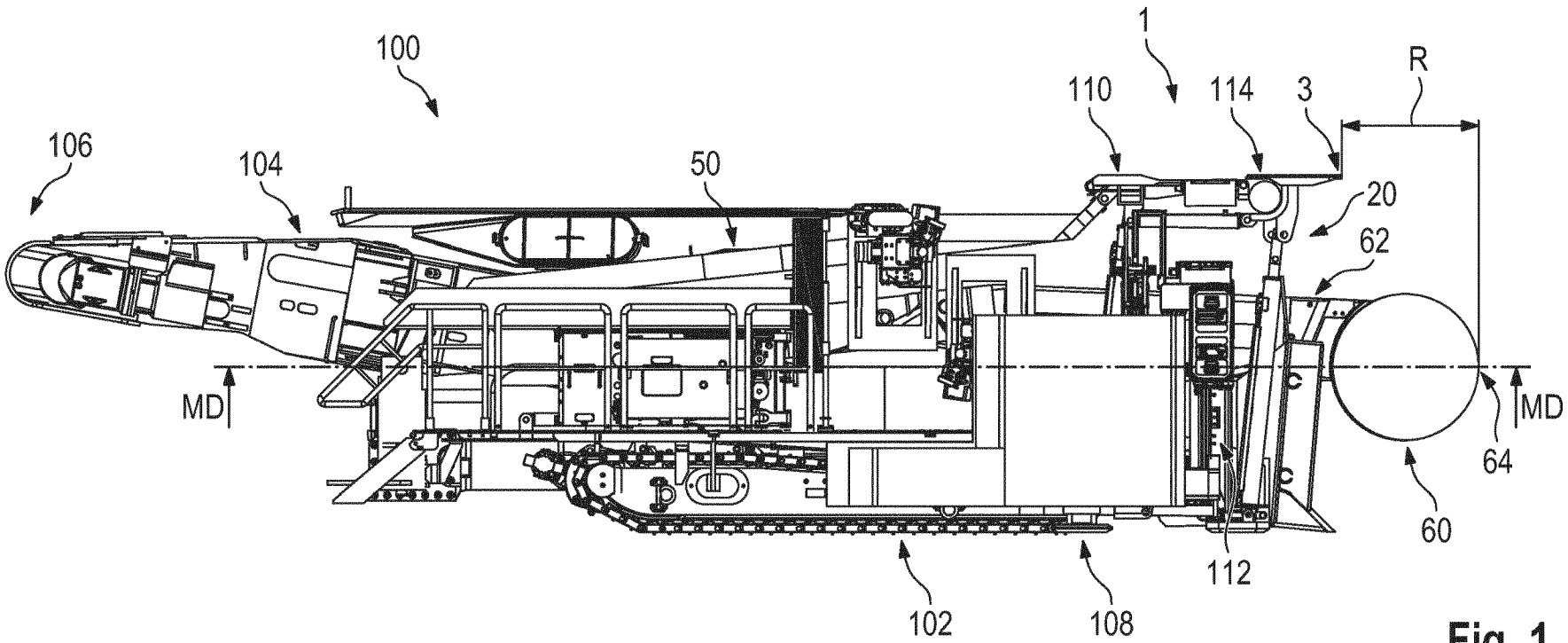
FIG. 1 shows a side view of a mining machine comprising an active temporary roof support apparatus.
Figure 2:
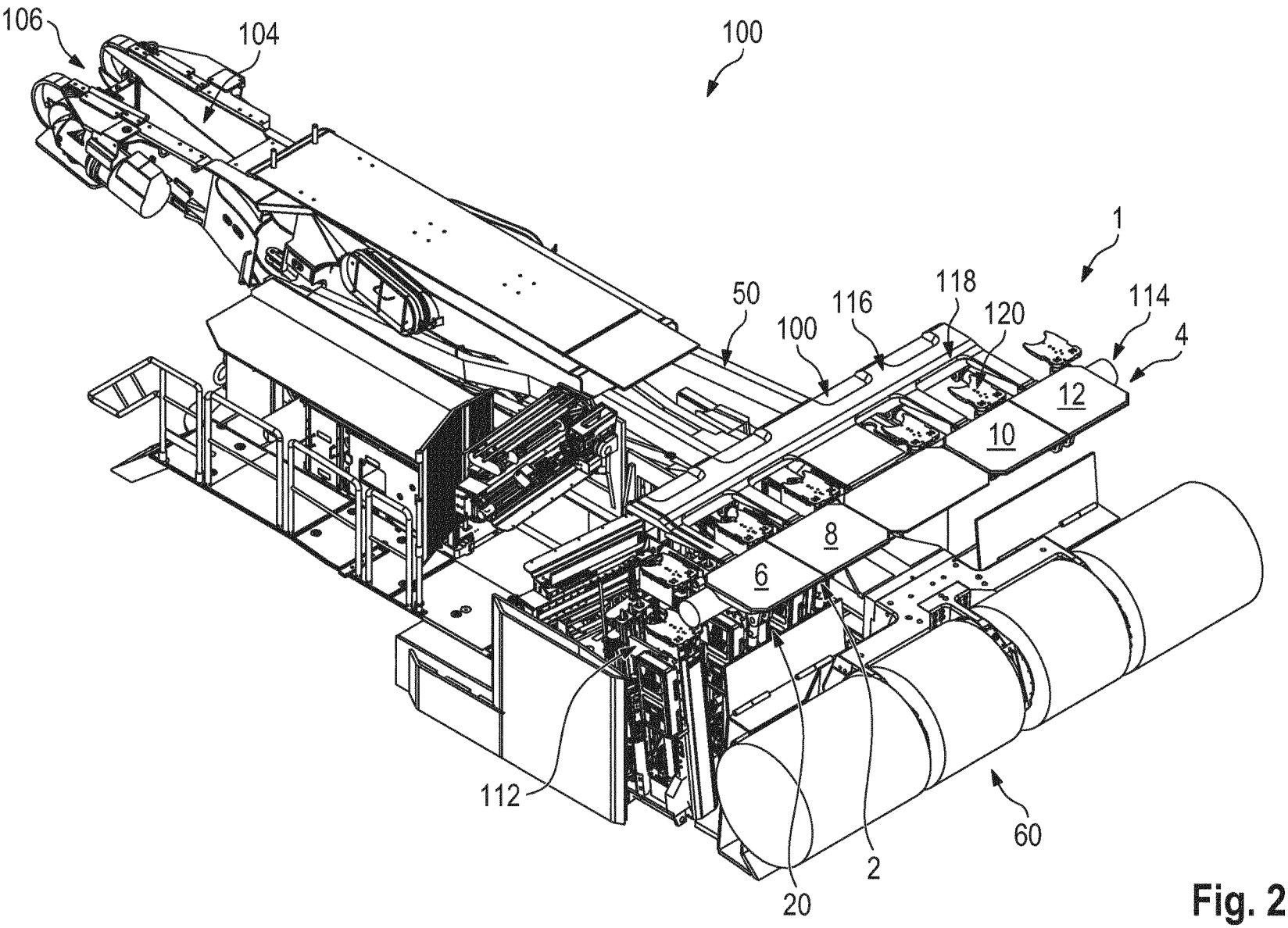
FIG. 2 shows an elevated perspective view of the mining machine of FIG. 1.
Figure 3:
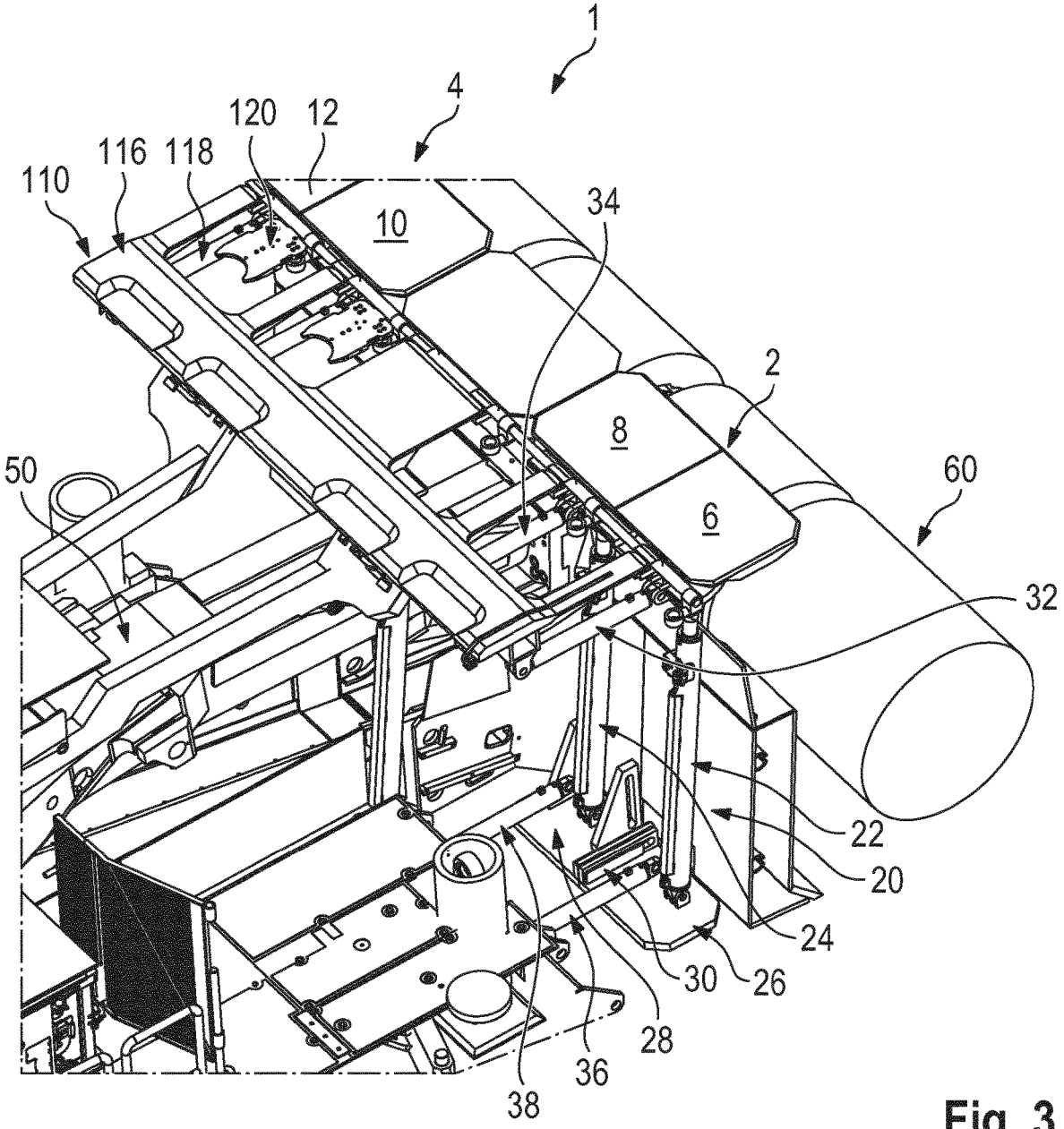
FIG. 3 shows an elevated perspective view of a portion of the mining machine of FIGS. 1 and 2.
Figure 4:
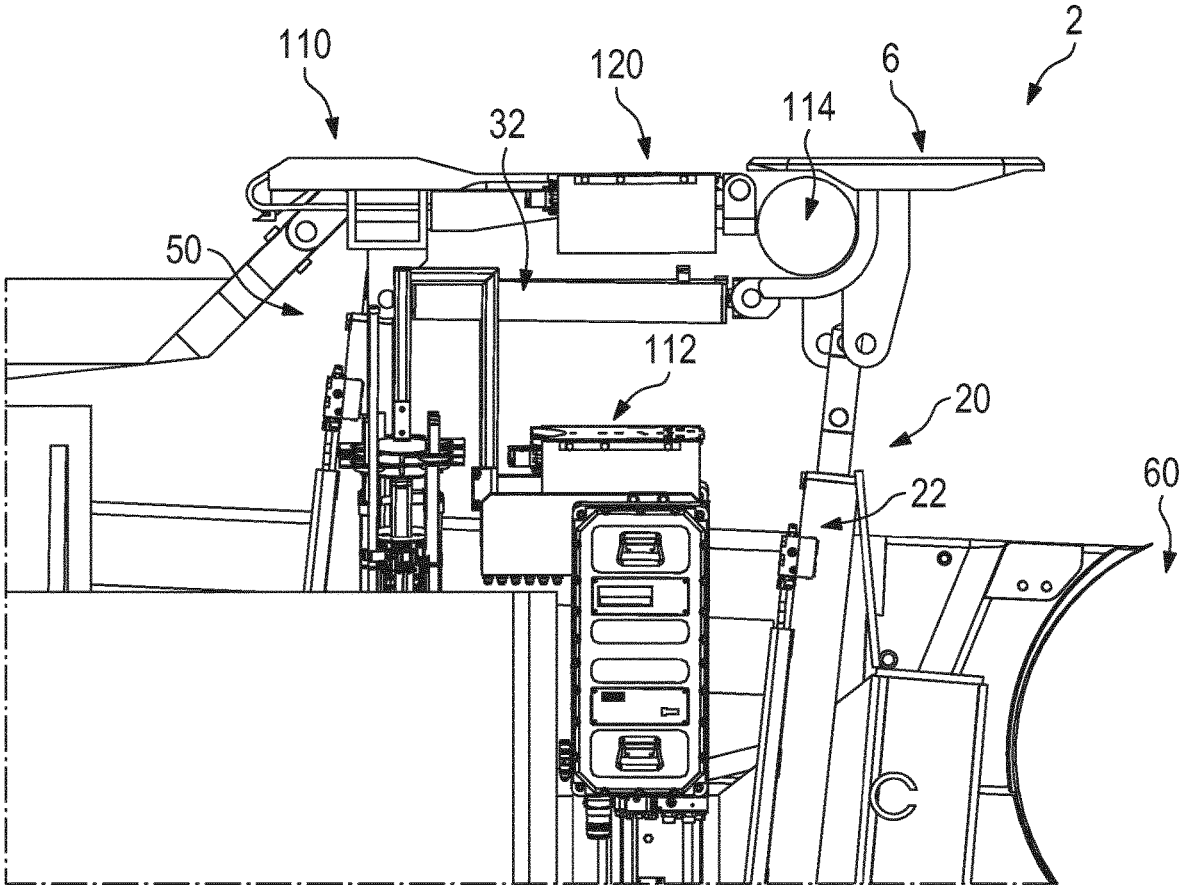
FIG. 4 shows a side view of an active temporary roof support apparatus mounted against a mining machine.

An active temporary roof support apparatus 1 (FIGS. 1 to 4) is attached to a mining machine 100 for cutting an underground tunnel. The mining machine 100 comprises a machine main frame 50 and a cutting unit 60. The cutting unit 60 is only shown in a schematic manner and is provided with a cutting unit advancing drive 61, which itself is supported by the main frame 50. The mining machine 100 moreover comprises crawler tracks 102 (only one shown in FIG. 1) for driving on an underground road way. The mining machine 100 also comprises a conveyer 104 for conveying excavated material from the cutting unit 60 to a discharge end 106 of the mining machine.

When performing a cutting operation, the mining machine 100 is braced between a roof of the tunnel and a floor of the tunnel. For this, the mining machine 100 comprises a bottom support structure 108 for engaging a floor of the underground tunnel and a machine stabilization 110 for engaging the roof of the tunnel. The machine stabilization 110 and the bottom support 108 together provide a force on the tunnel roof and floor, such that the mining machine 100 is braced when the cutting unit 60 is advanced into the rock material. At the same time also the machine stabilization 110 provides a temporary roof support. Additionally, the mining machine 100 comprises a bolting unit 112 for implementing a permanent roof support to the tunnel roof, by installing bolts or anchors into the tunnel roof.

As can be inferred from FIG. 1, the active temporary roof support apparatus 1 is arranged immediately behind the cutting unit 60 in the machine direction MD. In particular, the active temporary roof support apparatus 1 is provided between the cutting unit 60 and the machine stabilization 110 and also in front of the bolting unit 112 for implementing the permanent roof support.

The active temporary roof support apparatus 1 comprises according to this embodiment a first set 2 of support members 6, 8 and a second set 4 of support members 10, 12. It shall of course be understood, that any other number of sets and support members might be provided. It is not necessary, that each active temporary roof support apparatus 1 comprises two sets, also three, four, five and so forth sets are preferred. Moreover, it is not essential that each set 2, 4 comprises only two support members 6, 8, 10, 12. Much more the sets may also comprise three, four, five and so forth separate support members.

According to this embodiment, the support members 6, 8, 10, 12 are substantially plate shaped (see also FIG. 4) and have a substantially rectangular form. Again, this is also not essential. The form of the support members 6, 8, 10, 12 can vary depending on the application, as e.g. an inverted conic, or also mesh shape. The first and second support members 6, 8, 10, 12 are in sliding engagement with each other.

As can be inferred from FIG. 1, the range R between a front edge 64 of the cutting unit 60 and a front edge 3 of the active temporary roof support apparatus is in the range of 500 to 2000 mm, and thus, the active temporary roof support apparatus 1 is immediately behind the cutting unit. The specified range R is one example. The range can be scaled up, when e.g. using a larger cutting unit.

Beneath the first and second sets 2, 4 of support members 6, 8, 10, 12 is schematically shown a rolled mesh 114 which is used to permanently support the roof. The machine stabilization 110 comprises a bar shaped body 116 and four recesses 118 (only one indicated with reference sign in FIG. 2) which provide space for the drill carriages 120 of the bolting unit 112 (again only one drill carriage 120 indicated with reference sign in FIG. 2). As can be seen from FIG. 2, the machine stabilization 110 almost contacts the first and second sets 2, 4 of the active temporary roof support apparatus 1 and is thus arranged directly behind the sets 2, 4 (see also FIG. 4). Again, this allows a well-supported roof of the tunnel. The machine stabilization 110 is independent of the operation of the active temporary roof support apparatus 1. The support members 6, 8, 10, 12 can be repositioned even when the machine stabilization 110 is engaged with the roof for stabilizing the mining machine 100. At least one of the support members 6, 8, 10, 12 is adapted to provide an active support force to the roof in substantially vertical direction The active temporary roof support apparatus 1 comprises a drive assembly 20 (FIGS. 3 and 4) for moving the sets 2, 4 of support members 6, 8, 10, 12 such that the first and second support members 6, 8, 10, 12 are sequentially moved for engaging the roof such that the roof is supported by at least one of the support members 6, 8, 10, 12 during an excavation operation of the mining machine 100. The drive unit 20 comprises according to this embodiment first and second upright drives 22, 24 for each first and second support members 6, 8, 10, 12. Thus, each support member 6, 8, 10, 12 is provided with a separate upright drive 20, 22 (in FIG. 3 only 2 shown) such that the support members 6, 8, 10, 12 can be pushed upwardly independent from each other. For a floor support, each upright drive 22, 24 is provided with a bottom plate 26, 28, which are slidably attached to each other by a slide connection 30.

Moreover, the drive assembly 20 comprises upper forward drives 32, 34 (again in FIG. 3 only two drives shown) for each support member 6, 8, 10, 12. Thus, again each support member 6, 8, 10, 12 is provided with its own upper forward drives 32, 34 for advancing the support members 6, 8, 10, 12 in the machine direction MD (see FIG. 1). At the same time for positioning the bottom plates 26, 28, bottom forward drives 36, 38 are provided for the bottom plates 26, 28, such that the bottom plates 26, 28 can be positioned in accordance with the support member 6, 8, 10, 12. This allows to position the upright drives 22, 24 in a substantially vertical position, such that the support members 6, 8, 10, 12 can be pressed against the roof in a substantially vertical manner. All drives 22, 24, 32, 34, 36, 38 are driven pneumatically or hydraulically and the forward drives 32, 34, 36, 38 are supported by the main frame 50 of the mining machine 100. The upright drives 22, 24 are not supported additionally, they are only supported by the bottom plates 26, 28 and push against the support members 6, 8, 10, 12. Even though the upright, upper and bottom forward drives are not shown for the second set 4 of support members 10, 12 in FIG. 3, it shall be understood that they comprise a similar arrangement as the first set 2 of support members 6, 8.

Figure 5:
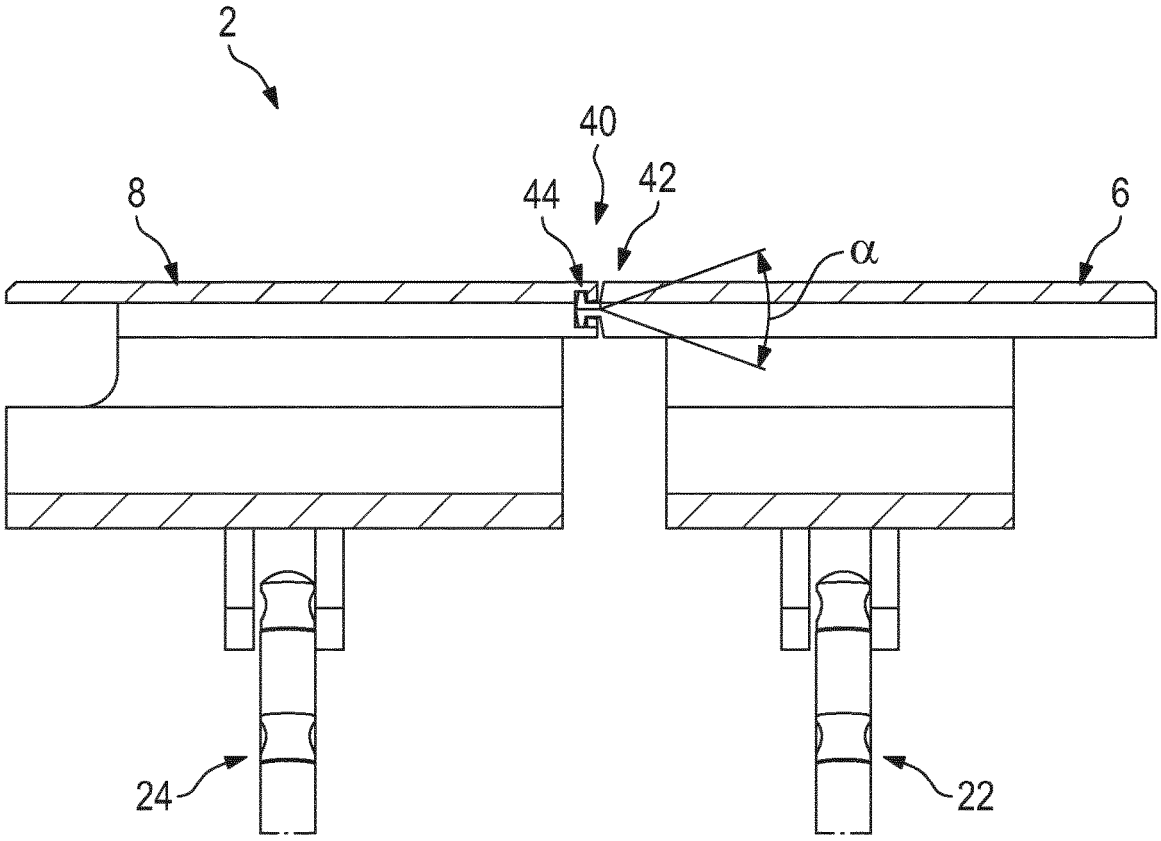
FIG. 5 shows a full cut through an active temporary roof support apparatus.

As shown in FIG. 5, the first support member 6 and the second support member 8 of the first set 2 of support members are connected to each other by a positive locking connection 40. This connection 40 comprises first engagement means 42 provided at the first support member 6 and second engagement means 44 which are provided at the second support member 8. The first engagement means 42 are formed as a protrusion which is substantially T-shaped and the second engagement means 44 are formed as a partially closed groove having an undercut or indentation, such that the T-shaped first engagement means 42 can be received in the second engagement means 44. The engagement means 42, 44 allow a relative movement of the support members 6, 8 to each other. A first movement is perpendicular to the drawing plane of FIG. 5, such that the support members 6, 8 can slide relative to each other in the machine direction MD (which is perpendicular to the plane of FIG. 5). Moreover, the tolerances of the first and second engagement means 42, 44 are selected such that the first and second support members 6, 8 can be pivoted to each other. In FIG. 5 it is shown that the first support member 6 can be pivoted with respect to the second support member 8 within an angle $\alpha$. This angle $\alpha$ is preferably in the range of 10° to 45°, in particular 10° to 30°. This allows that for example the first support member 6 is pivoted downwards by retracting the upward drive 22, than advanced forward into the direction of the plane of FIG. 5 and when engaged with the roof, again pivoted upwardly. The upward pivotal movement of the support members 6, 8 also allows for balancing deviations in the roof surface of the tunnel.

Figure 6:
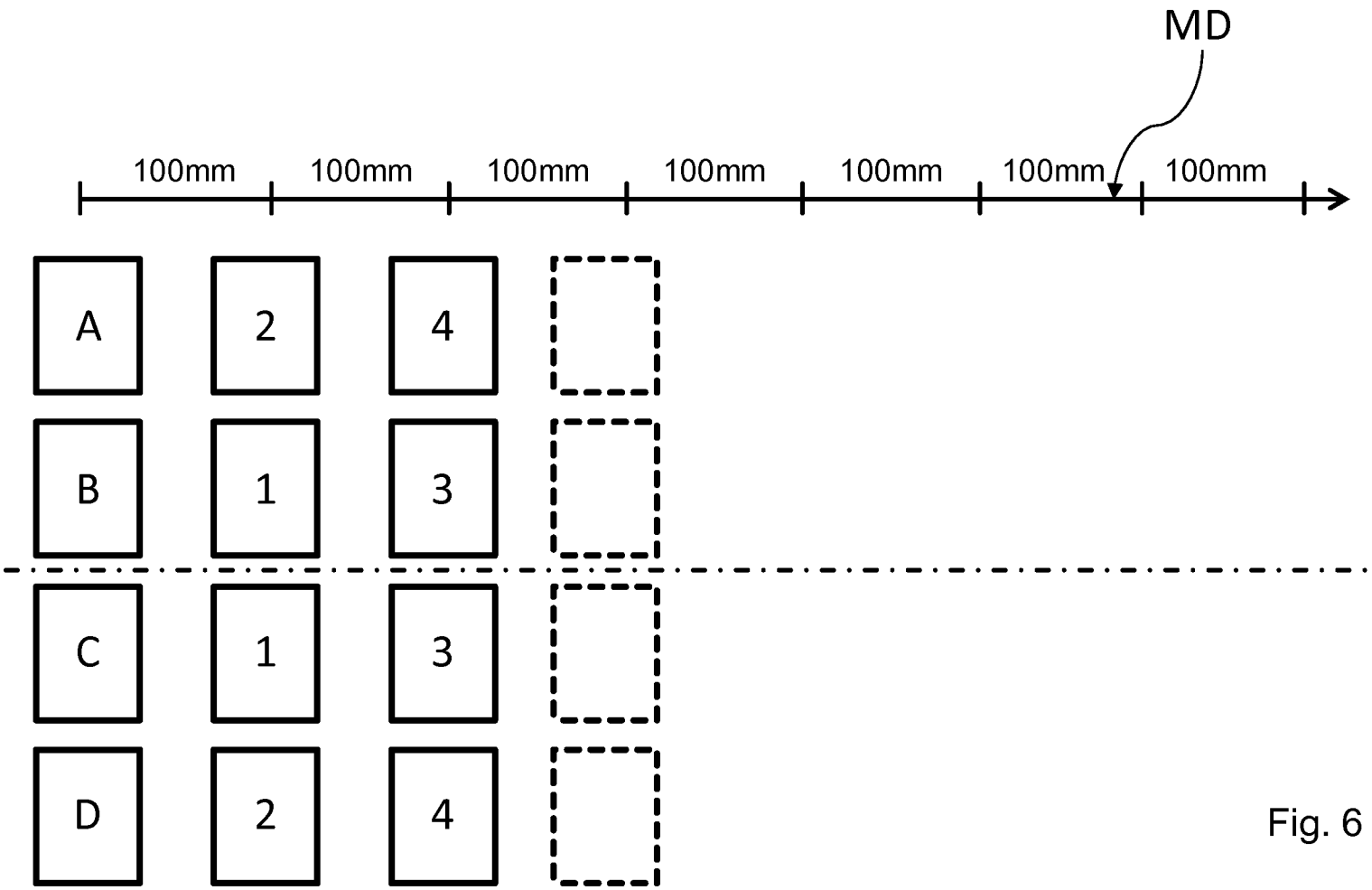
FIG. 6 shows a schematic illustration of a method according to the invention.
Figure 7:
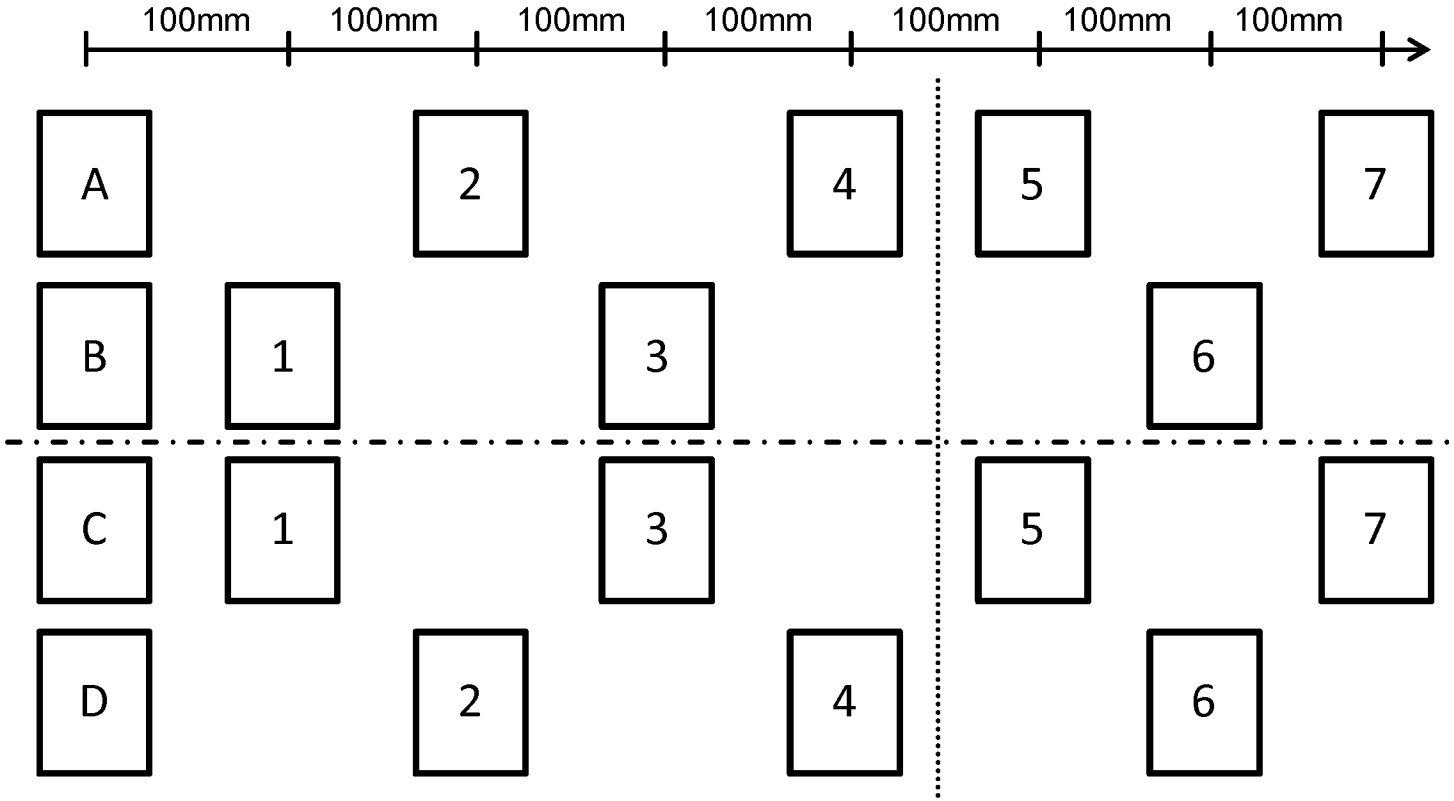
FIG. 7 shows a second schematic illustration of a method according to the invention.
Figure 8:
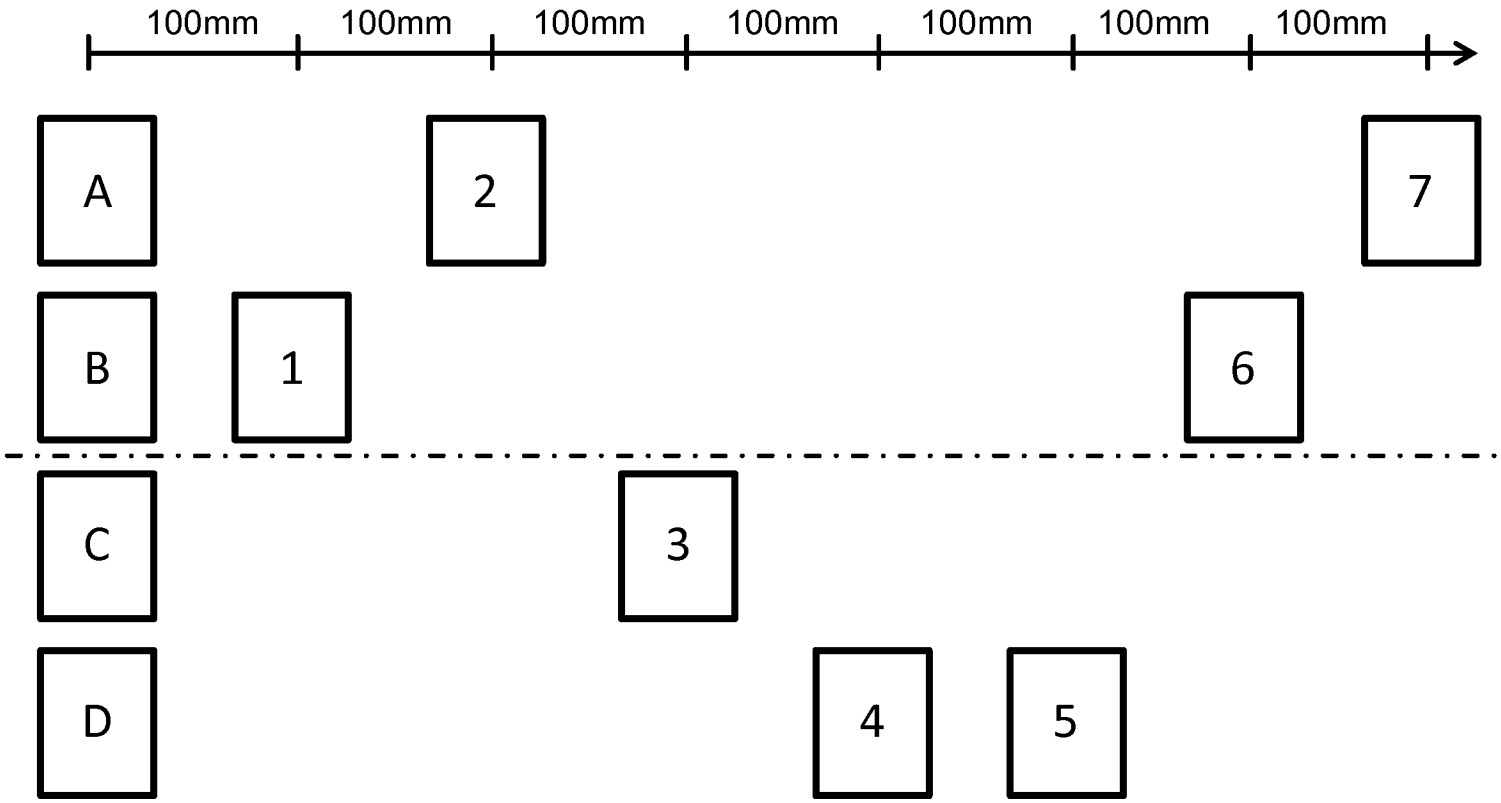
FIG. 8 shows a third schematic view of a representation of the method according to the invention.

FIGS. 6 to 8 now illustrate the walking movement of the active temporary roof support apparatus 1 according to the invention. First of all FIG. 6 shows the preferred schedule of movement. FIGS. 7 and 8 show alternative movements which are particularly suitable when advancing fast (FIG. 7) or having bad and uneven roof conditions (FIG. 8). In FIGS. 6 to 8 the machine direction MD is indicated to the left. Also the scale is indicated with steps of 100 mm. This is a suggested scale, which can be smaller or larger, such as e.g. 50 mm or 200 mm.

With reference to FIG. 6, on the left hand side four support members A, B, C, D are indicated in which the support members A, B belong to a first set of support members and the support members C, D to a second set of support members. With respect to the beforehand described embodiments, A equals 6, B equals 8, C equals 10, and D equals 12. The numbers in FIGS. 6 and 7 indicate the steps in which the support members A to D are advanced forward into the machine direction MD.

When the active temporary roof support apparatus 1 according to this embodiment (FIG. 6) is set into action in a first step (marked with number "1") the inner support members B, C are advanced forward and placed and engaged with the roof at a first area. When the support members B, C are engaged with the roof, the outer support members A and D are pushed forward and also placed and engaged with the roof. They are placed and engaged adjacent to the support members B, C, such that the roof is supported substantially over the whole width. When advancing forward, due to advancement of the mining machine 100 during an excavation operation, the support members B, C are disengaged and in a third step pushed forward and again engaged with the roof (shown with number "3" in FIG. 6). Subsequently, the outer support members A, D can follow and may be relocated and engaged as shown in step 4 of FIG. 6.

The dashed rectangular on the right hand side of FIG. 6 indicates that this operation as in the steps 1 to 4 of FIG. 6 is continued during the whole excavation operation.

FIG. 7 shows in a first section (steps 1 to 4) a second preferred walking scheme and in steps 5 to 7 a third preferred walking scheme. According to this embodiment of FIGS. 7 and 8, the first and second support members are arranged in the same manner, and therefore, in the first step (number 1 in FIG. 7), the second support member of the first set of support members (support member B) is advanced forward to a first area while at the same time the first support member of the second set of support members (support member C) is advanced to a second area. Thus, the inner support members are advanced and engaged with the roof portion. When the excavation operation continuous, the mining machine can move forward. While the support members B, C stay engaged (step 1), the support members A, D are not engaged with the roof and are free to advance forward. They advance forward about 200 mm, which is substantially equal to a length of the support members in the machine direction, overtaking the other support member. Due to the overtaking action, the active temporary roof support apparatus 1 may advance quickly in this embodiment (FIGS. 7 and 8).

Where indicated with number "2" FIG. 7, the support members A and D are engaged with third and fourth areas of the roof portion. Now support members B, C can be disengaged since support members A and D are engaged with the roof, and advanced forward as indicated by step 3. Thus, at about 300 mm from the initial position measured from the initial position, support members B, C are again engaged with the roof portion and support members A and D can be disengaged. They are subsequently advanced forward to step 4 and again engaged with the roof portion.

After the vertical dashed line in FIG. 7 in steps 5 to 7 a different walking scheme is shown. In this walking scheme the first and second support members of the first and second set of support members walk in accordance to each other. Thus, in step 5, support members A and C are engaged with the roof portion while support members B, D can advance forward. This is done in step 6. In step 6 support members B, D are engaged with the roof portion and members A and C are disengaged and advanced forward to step 8. Both walking schemes are preferred and can be carried out in average roof conditions.

When roof conditions are bad, it might be necessary to implement a different walking scheme. This is shown in FIG. 8. In FIG. 8 only support member B is engaged in the first step. In the second step support member A is being engaged. Now support member B can be disengaged. In the third step only support member C is engaged with the roof portion and also support member A can be disengaged. Subsequently in a fourth step, support member D is engaged. Now support member C is disengaged. Since support member 2 is still engaged with the roof portion, this is possible. Thus, support member D can be repositioned and engaged with the roof in step 5. Thus, in step 5 the support members A and D are engaged with the roof portion. In step 6 support member B is disengaged and support member A is positioned and engaged with the roof portion. Subsequently in step 7 also support member A is engaged with the roof portion. As can be understood from FIG. 8 also an asymmetrical walking scheme can be implemented, however, at all times at least one support member A, B, C, D is engaged with the roof portion and provides roof support. In general, the active temporary roof support apparatus 1 of the present invention allows a walking action of the support members 6, 8, 10, 12 along the roof of the tunnel for continuously supporting the roof.

The invention claimed is:

1. An active temporary roof support apparatus for attachment to a mining machine, comprising:

first and second sets of support members arranged adjacent to each other facing an advance direction of the machine such that the first set of support members is arranged on a lateral side of the second set of support members, each set of the first and second sets of support members including at least a first support member and a second support member arranged to support a roof of an underground tunnel; and a drive assembly arranged to drive the at least one set of support members such that the first and second support members are sequentially moved for alternatingly engaging the roof such that the roof is supported by at least one support member during an excavation operation of the mining machine, the first and second support members of the first set of support members being configured to be driven to move independently from the first and second support members of the second set of support members.

2. The active temporary roof support apparatus according to claim 1, wherein the drive assembly is arranged to move the first and second support members of the first set of support members oppositely relative to the first and second support members of the second set of support members.

3. The active temporary roof support apparatus according to claim 1, wherein the first and second support members are connected to each other.

4. The active temporary roof support apparatus according to claim 3, wherein the first support member includes a first engaging portion and the second support member includes a second engaging portion corresponding to and engaging the first engaging portion.

5. The active temporary roof support apparatus according to claim 4, wherein the first and second engaging portions are arranged to provide movement of the first and second support members in the machine direction.

6. The active temporary roof support apparatus according to claim 3, wherein the first and second engaging portions are arranged to pivot the first and second support members to each other in a predetermined angular range.

7. The active temporary roof support apparatus according to claim 1, wherein the drive assembly includes first and second upright drives arranged to move the first and second support members with respect to the roof.

8. The active temporary roof support apparatus according to claim 1, wherein the drive assembly includes first and second forward drives arranged to move the first and second support members in the machine direction.

9. A mining machine comprising:

a main frame;

a cutting unit; and an active temporary roof support apparatus according to claim 1 attached to the main frame and arranged in the machine direction immediately behind the cutting unit.

10. The mining machine according to claim 9, further comprising a machine stabilization having a support member arranged behind the active temporary roof support apparatus, the support member being arranged to stabilize the mining machine during an excavation operation.

11. A method for temporary supporting a roof of an underground tunnel during cutting the tunnel, comprising the steps in the following order:

providing an apparatus according to claim 1;

engaging a first area of the roof with the first support member;

engaging a second area of the roof with the second support member disengaging the first support member from the first area;

engaging a third area of the roof with the first support member; and disengaging the second support member from the second area.

12. The method according to claim 11, wherein the first, second, and third areas are arranged adjacent to each other and offset in the machine direction.

13. The method according to claim 11, wherein the first, second, and third areas are arranged immediately behind a cutting unit of a mining machine.

14. The method according to claim 11, comprising after disengaging the first support member the step of pushing the first support member forward in machine direction by a first range which is less than a distance twice as long as a length of the second support member seen in the machine direction.

15. The method according to claim 11, comprising after disengaging the first support member the step of pushing the first support member forward in machine direction by a first range which is less than a length of the second support member seen in the machine direction.

16. The method according to claim 11, wherein at least one support member is controlled to advance substantially simultaneously with the cutting unit.

17. The method according to claim 11, wherein the steps are carried out simultaneously as cutting the tunnel.

* * * * *